United States Patent [19]

Kinoshita et al.

[11] 4,450,807

[45] May 29, 1984

[54] SUCTION AIR THROTTLING DEVICE OF DIESEL ENGINE

[75] Inventors: Takahiko Kinoshita, Aichi; Nobuhiko Kakeno; Nobuhiro Miura, both of Toyota, all of Japan

[73] Assignee: Toyota Jidosha Kabushiki Kaisha, Toyota, Japan

[21] Appl. No.: 452,134

[22] Filed: Dec. 22, 1982

[30] Foreign Application Priority Data

Feb. 3, 1982 [JP] Japan ..... 57-14750

[51] Int. Cl.[3] ..... F02D 9/08

[52] U.S. Cl. ..... 123/403; 123/400

[58] Field of Search ..... 123/403, 342, 337, 400; 261/65, 41 C

[56] References Cited

U.S. PATENT DOCUMENTS 2,430,807 11/1947 De Marco ..... 123/400
2,635,595 4/1953 Raleigh ..... 123/403
2,762,235 9/1956 Olson et al. ..... 261/65
2,902,013 9/1959 Biermann ..... 123/403
3,342,454 9/1967 Tutch ..... 261/65

*Primary Examiner*—William A. Cuchlinski, Jr.
*Attorney, Agent, or Firm*—Oblon, Fisher, Spivak, McClelland & Maier

[57] ABSTRACT

A suction air throttling device of a diesel engine in which a throttle valve is opened or shut along with the accelerator operation, wherein there is arranged a link connected with an accelerator pedal and opening or shutting the throttle valve in accordance with depression of the accelerator pedal, the rotating axis of the link being positioned eccentrically from the rotation center of the throttle valve shaft, so that the opening degree of the throttle valve is larger in the small opening degree zone of the link and the opening degree of the throttle valve is smaller in the large opening degree zone of the link, whereby the characteristic curve between the opening degrees of the throttle valve and the accelerator is a convex line.

2 Claims, 4 Drawing Figures

SUCTION AIR THROTTLING DEVICE OF DIESEL ENGINE

BACKGROUND OF THE INVENTION

1. Field of the Invention

The present invention relates to a suction air throttling device of a diesel engine, more particularly, to a suction air throttling device of a diesel engine in which a throttle valve is interlocked with an accelerator.

2. Description of the Prior Art

In a conventional pneumatic speed governor, meaning, in a broad sense, a speed governor in which vacuum of a Venturi tube is used to operate a fuel pump for control of the fuel injection volume by a throttle valve, the throttle valve is interlocked with the accelerator. The opening degree of the throttle valve is in a one-to one linear relationship, i.e., a directly proportional relationship to the opening degree of the accelator. Therefore, more vacuum than necessary is generated in the suction tube due to the engine rotational load during the control of the fuel injection.

Thus results in considerable pumping loss of the engine. For this reason, large-sized diesel engines, for which economicalness, i.e., fuel consumption, is important, generally do not use such pneumatic speed governors for controlling their fuel injection, but use centrifugal governors.

SUMMARY OF THE INVENTION

The present invention was made in consideration of the above-mentioned problem of conventional pneumatic speed governors.

The object of the present invention is to provide a suction air throttling device of a diesel engine in which a throttle valve is interlocked with an accelator, in which a small depression of the accelerator pedal will result in a large opening the throttle valve, thereby reducing the pumping loss in the half-throttling zone and improving the fuel consumption and in which, in a turbo charger diesel engine, the response characteristics at turbo-charger acceleration are improved.

The present invention provides a suction air throttling device of a diesel engine comprising a housing having a suction passage and comprising a throttle valve located in the suction passage and mounted on a rotary shaft supported in the housing, the throttle valve being connected with an accelerator pedal and opening the suction passage during accelerator operation and shutting the suction passage during NON-accelerator operation. The device is characterized in that there are arranged a first link, fixed to the end of the rotary shaft on which the throttle valve is mounted and having an arc-shaped hole, and a second link, connected with the accelerator pedal via a wire and rotating around a shaft mounted on the housing eccentrically from the rotary shaft on which the throttle valve is mounted and having a roller on the end thereof which slidably fits into the arc-shaped hole of the first link. The arc-shaped hole is shaped so that the opening degree of the throttle valve is larger in the small opening degree zone of the second link and the opening degree of the throttle valve is smaller in the large opening degree zone of the second link. As the second link is connected with the accelerator pedal, the curve between the opening degrees of the throttle valve and the accelerator is therefore a convex line.

By applying the present invention to a suction air throttling device of a diesel engine in which a throttle valve is interlocked with an accelerator, the following advantageous effect results. The throttle valve opens to a large degree along with a small depression of the accelerator pedal and a small degree along with a large depression, i.e., the curve between the opening degrees of the throttle valve and the accelerator is a convex line. Therefore, the suction resistance during half-throttling is small. Thus, the fuel consumption is improved. Also, in a turbo charger diesel engine, it is possible to prevent the reduction of the turbo charger speed due to insufficient air and to prevent problems such as slow rise of the turbo charger pressure during acceleration.

DETAILED DESCRIPTION OF THE PREFERRED EMBODIMENT

The structure of the present invention will now be described with reference to a preferred embodiment illustrated in the accompanying drawings.

Figure 1:
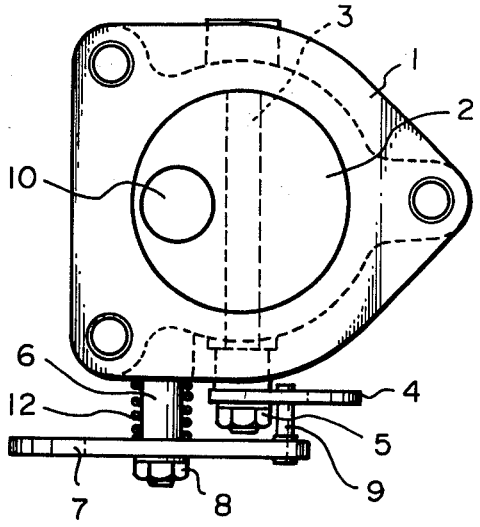
FIG. 1 is a plan view of a device according to a preferred embodiment of the present invention.
Figure 2:
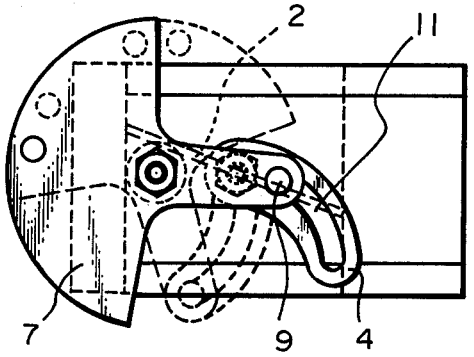
FIG. 2 is a side view of the device shown in FIG. 1.

In FIGS. 1 and 2, reference numeral 1 represents a throttle valve housing and reference numeral 2 represents a butterfly valve used as a throttle valve. The butterfly valve 2 is mounted on a valve shaft 3 rotatably attached to the housing 1. A first link 4 is fixed on the end of the valve shaft 3 by a nut 5. An arc-shaped hole 11 is bored in the first link 4.

A link shaft 6, in addition to the valve shaft 3, is fixedly mounted on the housing 1, parallel to the valve shaft 3. A second link 7 is rotatably attached on the link shaft 6 by a nut 8. A roller 9 is mounted on the end of the second link 7. The roller 9 is slidably fitted into the arc-shaped hole 11 of the first link 4, so that the first link 4 is interlocked with the second link 7. The second link 7 is connected with an accelerator pedal (not shown) via a wire, so that the butterfly valve 2 opens or shuts along with the operation of the accelerator pedal.

Figure 3:
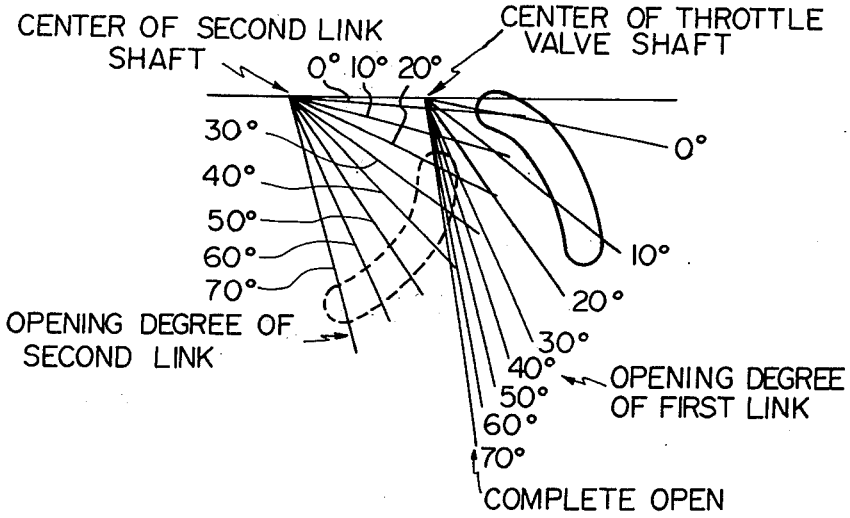
FIG. 3 is a diagramatic drawing showing the relation between the opening degrees of the first link, connected with a throttle valve, and the second link, connected with an accelerator pedal, and showing the shape of the arc-shaped hole of the first link.

The relation between the opening degree of the first link 4 connected with the butterfly valve 2 and the opening degree of the second link 7 connected with the accelerator pedal is shown in FIG. 3. The second link 7 opens by successive fixed increments of angle (rotates clockwise around the link shaft 6 in FIG. 2), while the first link 4 opens by a large degree at the initial stage, then opens gradually smaller along with the increasing opening degree of the second link 7. The relation of the opening degree of the butterfly valve 2 to the opening degree of the second link 7 is a convex line, such as the chain line A in FIG. 4, and not a straight line, such as the solid line B in FIG. 4 showing the opening degree characteristic of the conventional device.

Reference numeral 10 represents a hole bored in part of the butterfly valve 2. The hole 10 allows the passage of a little suction air, even when the butterfly valve 2 is shut to its maximum extent, so that the engine operation will not stop. Reference numeral 12 represents a spring provided around the link shaft 6 for returning the second link 7.

In the above-mentioned suction air throttling device according to the preferred embodiment of the present invention, when a driver steps on the accelerator pedal from the NON-stepped state, i.e., the state where the butterfly valve 2 is shut completely, the second link 7 rotates clockwise (FIGS. 1 and 2) around the link shaft 6, the roller 9 attached on the end of the second link 7 rolls along the hole 11 of the first link 4, the first link 4 rotates clockwise due to the roller 9 revolution, and, these links 4 and 7 shift to the position shown by a chain line in FIG. 2. Consequently, the butterfly valve 2 opens.

Figure 4:
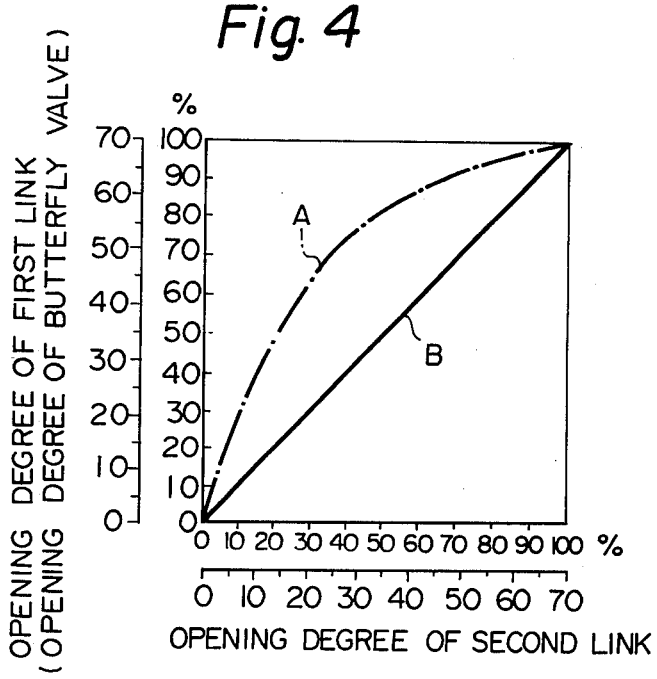
FIG. 4 is a diagram showing the opening degree curve of the throttle valve.

At this time, the opening degree of the first link 4 is larger in the small opening degree zone of the second link 7 and the opening degree of the first link 4 is smaller in the large opening degree zone of the second link 7, as shown in FIG. 4, so that the curve between the opening degrees of the first link 4 and second link 7 is a convex line. Therefore, the butterfly valve 2 opens to a large degree along with a small depression of the accelerator pedal.

Thus, the opening degree of the butterfly valve 2 is large during half-throttling than the conventional device, so that the suction resistance decreases and much more air is supplied.

In the above-mentioned embodiment, the hole 10 is provided to allow passage of enough air to prevent obstruction of engine operation in the butterfly valve. Instead of the hole 10, the butterfly valve 2 may be constructed to remain open a little even when closed to the maximum extent.

We claim:

1. A suction air throttling device of a diesel engine comprising a housing having a suction passage and comprising a throttle valve located in said suction passage and mounted on a rotary shaft supported in said housing, said throttle valve being connected with an accelerator pedal and opening said suction passage when an accelerator operates and shuts said suction passage when the accelerator does not operate, characterized in that there are arranged a first link, being fixed on the end of said rotary shaft on which said throttle valve is mounted and having an arc-shaped hole, and a second link, connected with the accelerator pedal via a wire and rotating around a shaft mounted on said housing eccentrically from said shaft on which said throttle valve is mounted and having a roller on the end thereof which slidably fits into said arc-shaped hole of the first link, said arc-shaped hole of the first link being shaped so that the opening degree of said throttle valve is larger in the small opening degree zone of the second link and the opening degree of said throttle valve is smaller in the large opening degree zone of the second link, whereby the characteristic curve between the opening degrees of said throttle valve and the accelerator is a convex line.

2. A suction air throttling device of a diesel engine according to claim 1, wherein said throttle valve is provided with a small hole allowing the passage of a little suction air even when said throttle valve is shut to the maximum extent.

* * * * *